US007431605B2

(12) United States Patent
Dieterle et al.

(10) Patent No.: US 7,431,605 B2
(45) Date of Patent: Oct. 7, 2008

(54) CONNECTOR POSITION ASSURANCE APPARATUS

(75) Inventors: Derrick Dieterle, Brighton, MI (US); Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/634,215

(22) Filed: Dec. 6, 2006

(65) Prior Publication Data

US 2008/0139034 A1 Jun. 12, 2008

(51) Int. Cl.
*H01R 13/627* (2006.01)

(52) U.S. Cl. ..... 439/358; 439/489; 439/948

(58) Field of Classification Search ..... 439/357, 439/489, 358, 352–354, 570, 948
See application file for complete search history.

(56) References Cited

U.S. PATENT DOCUMENTS 5,116,247 A * 5/1992 Enomoto et al. ..... 439/660
5,188,535 A * 2/1993 Bertho et al. ..... 439/83
5,501,009 A * 3/1996 McClure ..... 29/882
5,626,482 A * 5/1997 Chan et al. ..... 439/74
5,876,217 A * 3/1999 Ito et al. ..... 439/74
5,913,703 A * 6/1999 Suzuki et al. ..... 439/701
6,135,785 A * 10/2000 Niitsu ..... 439/74
6,261,116 B1 7/2001 Ceru
6,315,585 B1 * 11/2001 Oka ..... 439/157
6,319,050 B1 * 11/2001 Miyazaki et al. ..... 439/489
6,435,895 B1 8/2002 Fink et al.
6,488,520 B1 * 12/2002 Hayes et al. ..... 439/188
6,824,406 B1 * 11/2004 Sharples et al. ..... 439/157
6,881,075 B2 * 4/2005 Huang et al. ..... 439/74
6,945,801 B2 9/2005 Brown
2002/0045380 A1 * 4/2002 Endo et al. ..... 439/489
2004/0038584 A1 * 2/2004 Zahlit et al. ..... 439/489
2004/0214470 A1 * 10/2004 Hori ..... 439/489

* cited by examiner

*Primary Examiner*—Neil Abrams
*Assistant Examiner*—Harshad C Patel
(74) *Attorney, Agent, or Firm*—Rader, Fishman & Grauer, PLLC

(57) ABSTRACT

A connector position assurance apparatus includes a header part, an electrically-conductive element connected to the header part and a connector part. As the connector part is received by an interior connector-receiving chamber of the header part, a pair of polarity tabs contact an electrical contact portion of the electrically-conductive element causing the electrical contact portion to move from a relaxed state to a stressed state while a latch member slides onto and over a catch projecting from the header part causing the latch member to pivotably move from a relaxed condition to a flexed condition and then back to the relaxed condition again when a catch-receiving chamber formed in the latch member receives the catch thereby releasably locking the connector part and the header part together while the pair of polarity tabs retain the electrical contact portion in the stressed state. Movement of the contact portion to the stressed state closes a circuit on a printed circuit board to provide assurance that the header part and the connector part are properly mated.

33 Claims, 9 Drawing Sheets

CONNECTOR POSITION ASSURANCE APPARATUS

FIELD OF THE INVENTION

The present invention relates to a connector position assurance apparatus.

BACKGROUND OF THE INVENTION

Connector position assurances devices are known in the art. For instance, U.S. Pat. No. 6,488,520 to Hayes, et al. discloses an electrical connector assembly with shorting members. The electrical connector includes a housing, electrical contacts connected to the housing and electrical shorting members connected to the housing. Each contact includes a male contact area to form a male electrical connector. Each shorting member is adapted to electrically connect at least two of the contacts to each other. Each one of the contacts is connected to at least one other contact of the contacts in the connector by the shorting member. The shorting members are each movable to a position spaced from the contacts. The contacts are aligned in an array of at least two rows with multiple ones of the contacts in each row.

U.S. Pat. No. 6,945,801 to Brown teaches and electrical connector that has a connector position assurance member. The electrical connector includes a housing having a deflectable cantilevered mating connector latch arm, electrical contacts connected to the housing and a connector position assurance (CPA) member movably mounted to the housing between an open position and a closed position. The CPA member includes a top section and two downwardly extending rails. Each rail has a bottom end adapted to contact a shorting clip of a mating electrical connector and moves the shorting clip off of connection with contacts of the mating electrical connector. The first rail includes a wedge surface and a detent locating surface. The wedge surface is adapted to be contacted by the mating electrical connector to deflect the first rail. When the CPA member is moved to the closed position, the detent locating surface is CPA member is moved to the closed position, the detent locating surface is adapted to be positioned below a detent surface of the housing to retain the CPA member in the closed position.

The connector position assurance devices in the prior art such as the prior art discussed above are rather large for smaller connectors. As a result, a large amount of space is occupied.

It would be beneficial to provide a connector position assurance apparatus that is suitable for smaller connectors thereby occupying a smaller amount of space. The present invention provides these benefits.

SUMMARY OF THE INVENTION

One exemplary embodiment of a connector position assurance apparatus of the present invention is adapted for use with a printed circuit board having a first electrical printed circuit board contact and a second printed circuit board electrical contact electrically isolated from the first electrical printed circuit board contact. The connector position assurance apparatus includes a header part, an electrically-conductive element and a connector part. The header part is operably connected to the printed circuit board and has a header outer surface and a header inner surface. The header inner surface defines an interior connector-receiving chamber. The header part has a catch that is connected to and projects from the header outer surface.

The electrically-conductive element has a main body portion and at least one electrical contact portion integrally formed with the main body portion. The electrically-conductive element is connected to the header part at the main body portion. The at least one electrical contact portion is movable between a relaxed state and a stressed state and is resiliently biased to the relaxed state.

The connector part is sized and adapted to be slidably received by the interior connector-receiving chamber of the header part and has at least one polarity tab and a latch member. The latch member has a catch-receiving chamber formed therein and is pivotably movable to and between a relaxed condition and a flexed condition with the latch member being resiliently biased to the relaxed condition.

As the connector part is received by the interior connector-receiving chamber in a connector receiving direction, the at least one polarity tab contacts the at least one electrical contact portion causing the at least one electrical contact portion to move from the relaxed state to the stressed state when the at least one electrical contact portion contacts one of the first and second printed circuit board contacts while the latch member slides onto and over the catch causing the latch member to pivotably move from the relaxed condition to the flexed condition and then back to the relaxed condition again when the catch-receiving chamber receives the catch. Thus, the connector part and the header part are releasably locked together while the at least one polarity tab retains the at least one electrical contact portion in the stressed state and in electrical contact with the one of the first and second printed circuit board contacts resulting in electrical communication between the first and second printed circuit board contacts.

Other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
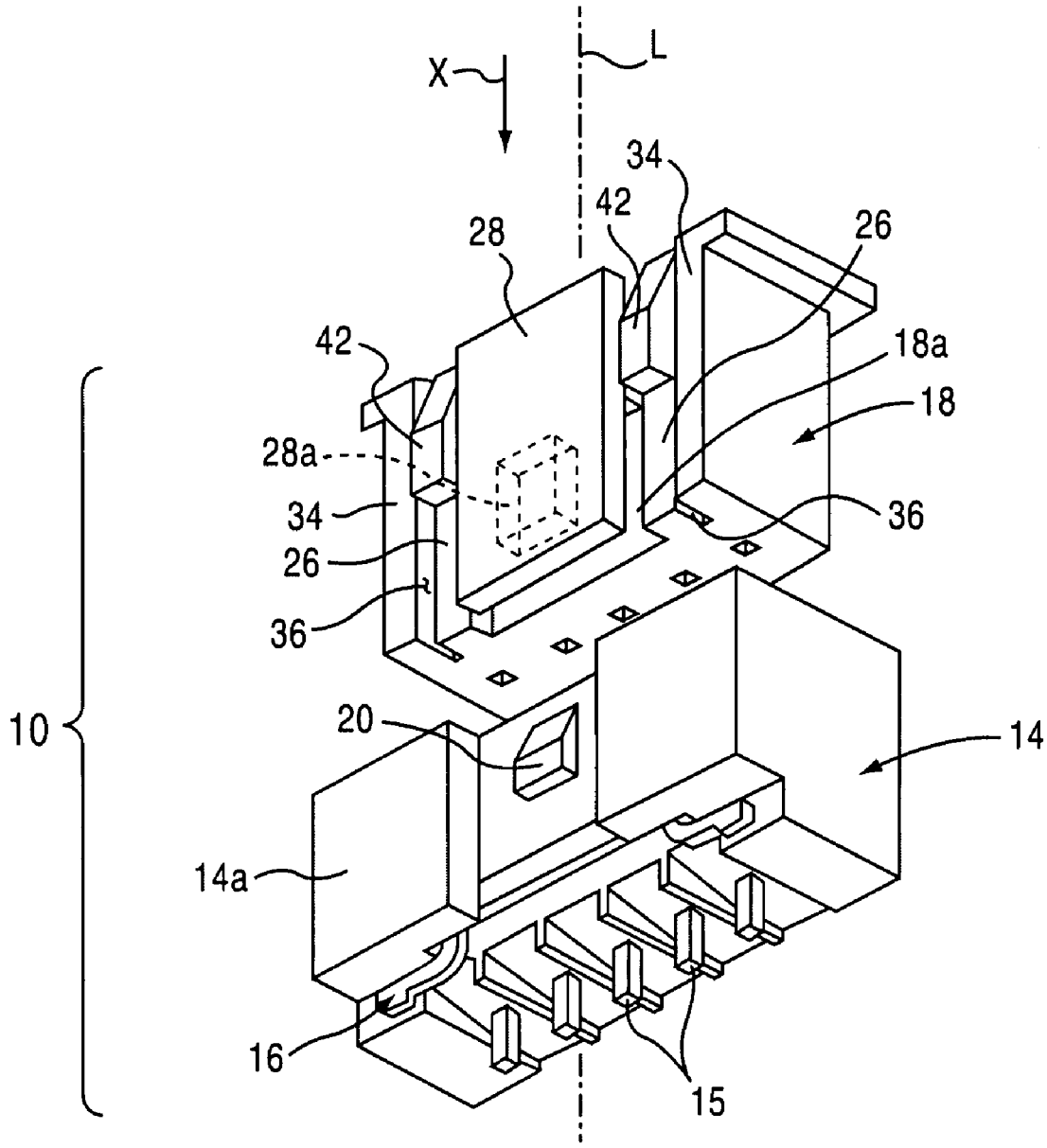
FIG. 1 is an exploded bottom perspective view of one exemplary embodiment of a connector position assurance apparatus of the present invention with a connector part disengaged from a header part.

Hereinafter, embodiments of the present invention will be described with reference to the attached drawings. The structural components common to those of the prior art and the structural components common to respective embodiments of the present invention will be represented by the same symbols and repeated description thereof will be omitted. Further, any references to direction or orientation of the components are described by terms such as "upward", "downward", "top", "bottom" or the like for simplicity of explaining the inventions to the reader and shall not be used to limit the scope of the invention. It was determined that using non-descriptive terms for orientation or direction such as "first", "second" or the like would unduly complicate and, possibly, obfuscate, the description of the invention.

A first exemplary embodiment of a connector position assurance apparatus 10 of the present invention is hereinafter described with reference to FIGS. 1-7(*d*). As best shown in FIGS. 3-6, the connector position assurance apparatus 10 of the present invention is adapted for use with a printed circuit board 12. The printed circuit board 12 has a first electrical printed circuit board contact 12*a* and a second printed circuit board electrical contact 12*b* electrically isolated from the first electrical printed circuit board contact 12*a*. The connector position assurance apparatus 12 includes a header part 14, an electrically-conductive element 16 and a connector part 18. Although not by way of limitation and by way of example only, the connector part 18 is illustrated in the drawing figures as a female connector part and retains wires 19 (FIG. 2) in a manner known in the art. Although not by way of limitation and by way of example only, the header part 14 can be a male connector part that retains electrical terminals 15 (FIG. 1) in a manner known in the art which connect to the printed circuit board 12 (FIG. 3) in a manner known in the art.

Figure 2:
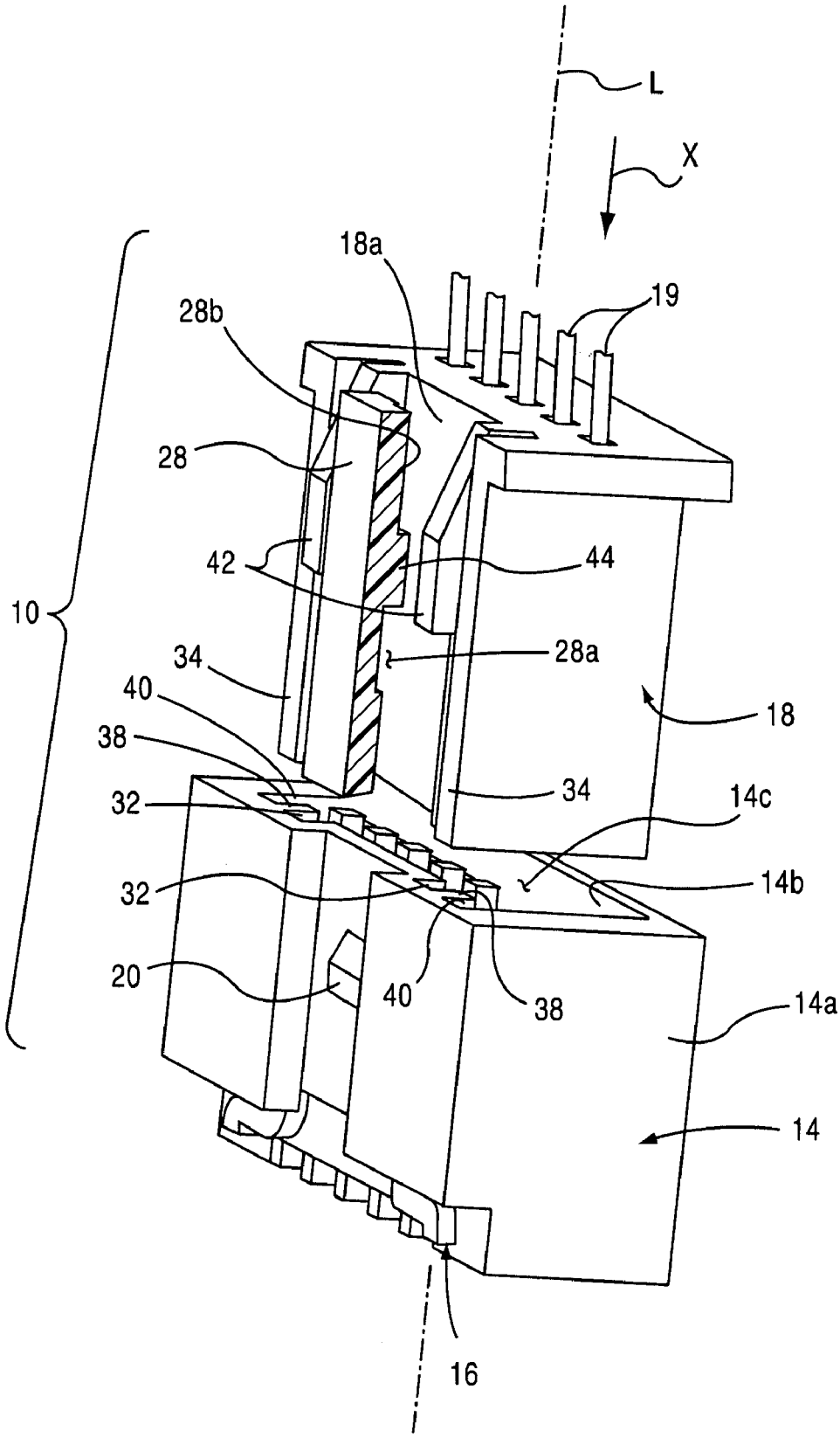
FIG. 2 is an exploded top perspective view of the connector position assurance apparatus illustrated in FIG. 1.
Figure 3:
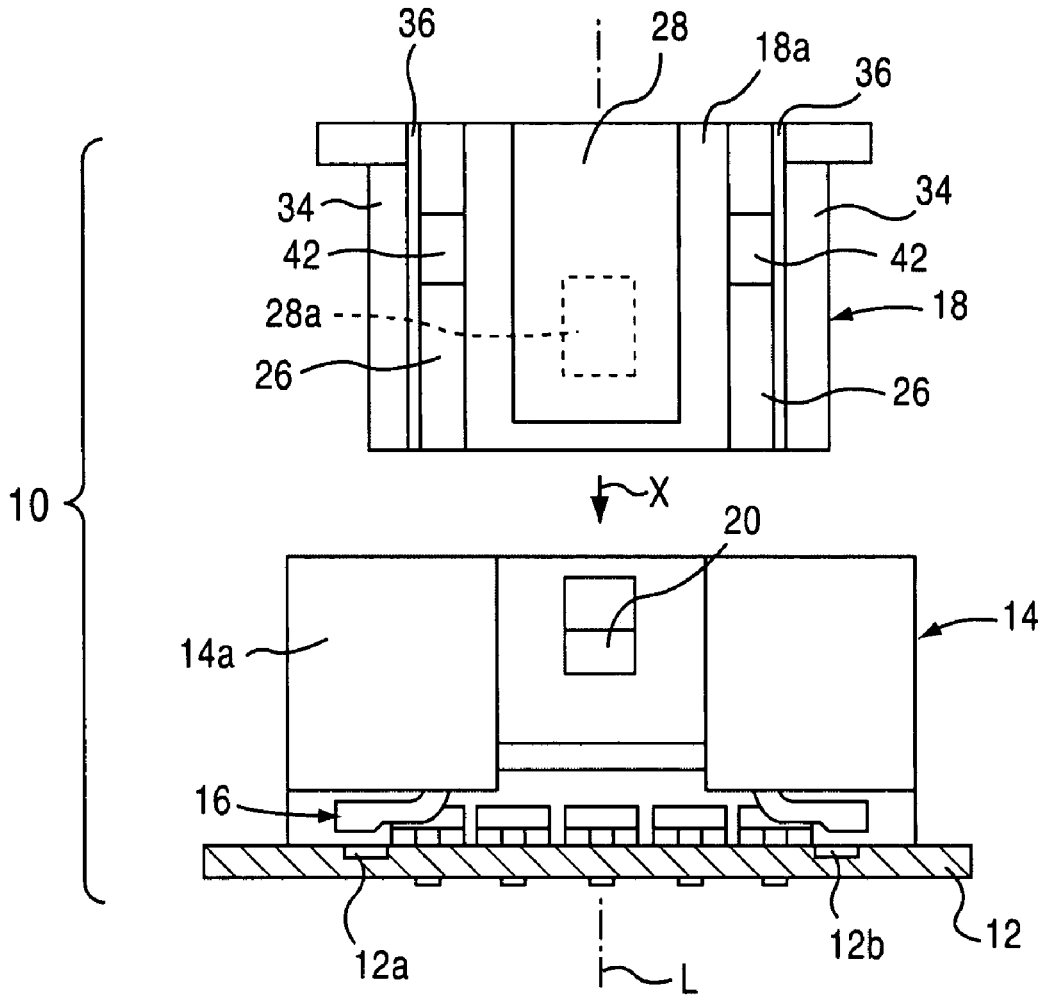
FIG. 3 is an exploded front elevational view of the connector position assurance apparatus illustrated in FIGS. 1 and 2 with a header part operably connected to a printed circuit board.

As shown in FIGS. 3-6, the header part 14 is operably connected to the printed circuit board 12. As best shown in FIG. 2, the header part 14 has a header outer surface 14*a* and a header inner surface 14*b*. The header inner surface 14*b* defines an interior connector-receiving chamber 14*c*. In FIGS. 1-3, the header part 14 has a catch 20 that is connected to and projects from the header outer surface 14*a*.

Figure 4:
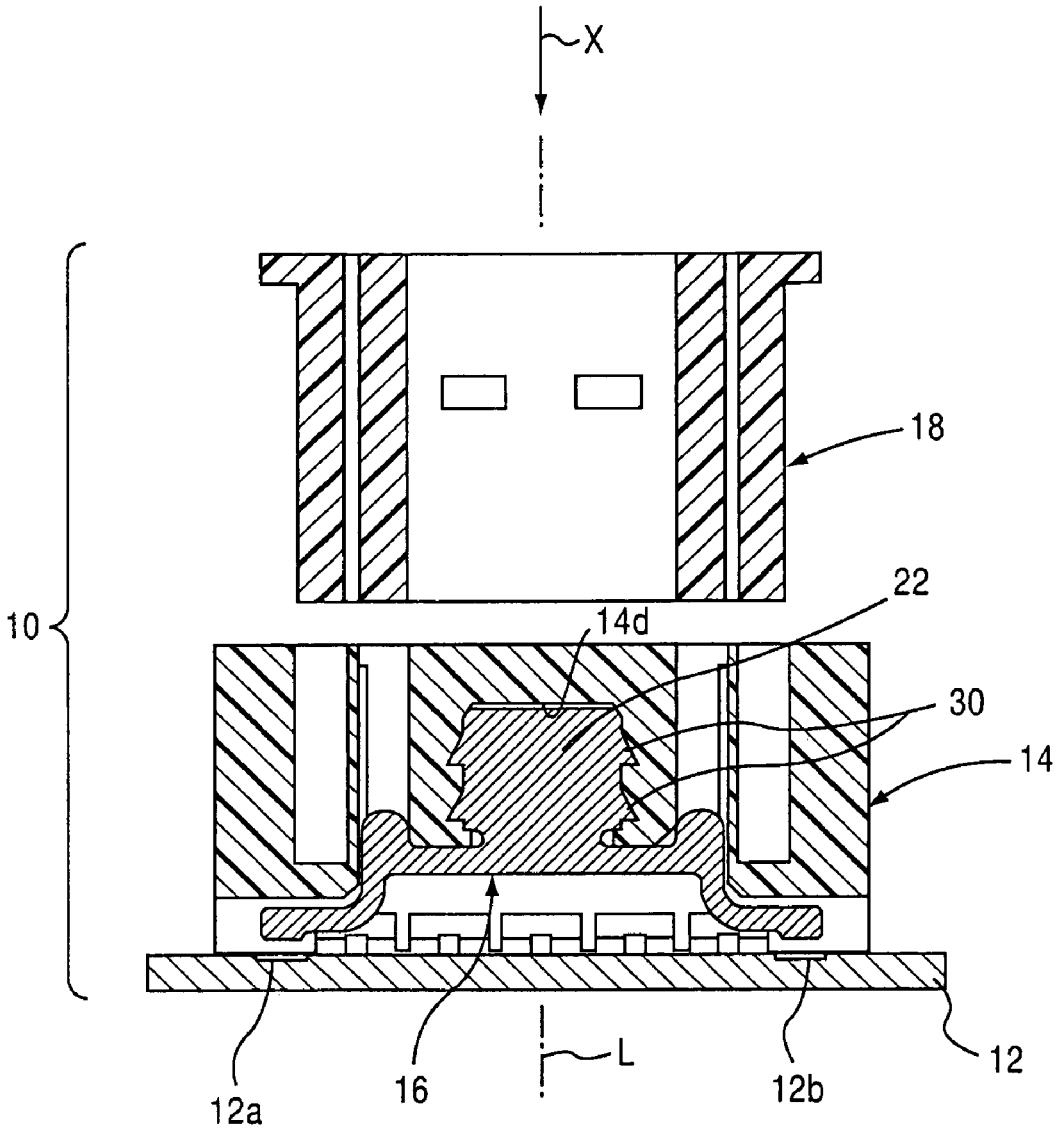
FIG. 4 is an exploded front elevational cross-section view of the connector position assurance apparatus illustrated in FIGS. 1 and 2 with the header part operably connected to the printed circuit board.
Figure 5:
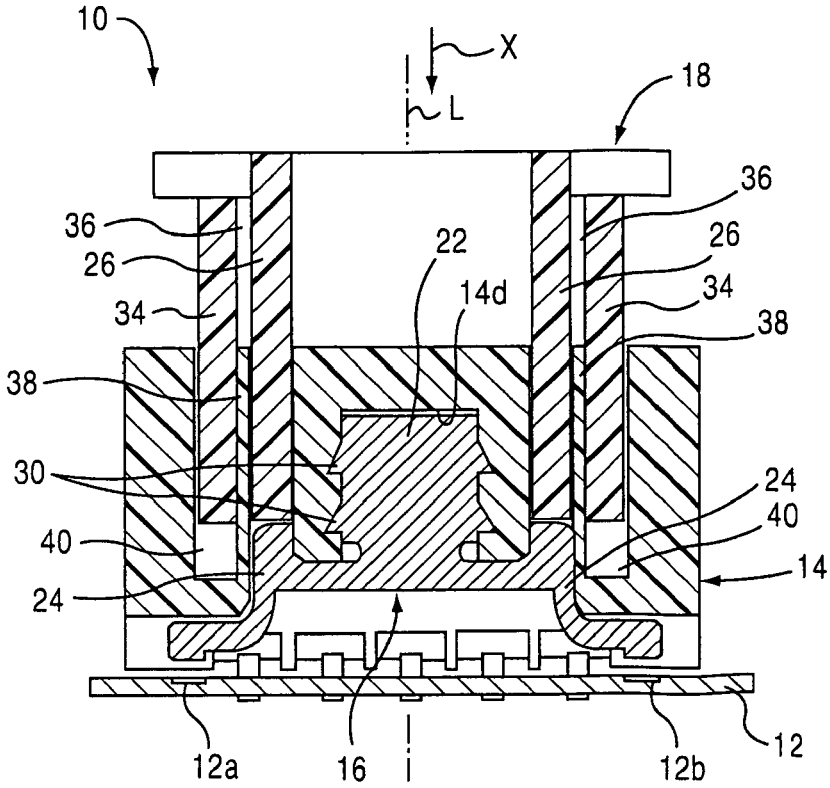
FIG. 5 is a front elevational cross-section view of the connector position assurance apparatus with the header part operably connected to the printed circuit board and the connector part engaged with the header part and contacting an electrically-conductive element in a relaxed state.
Figure 6:
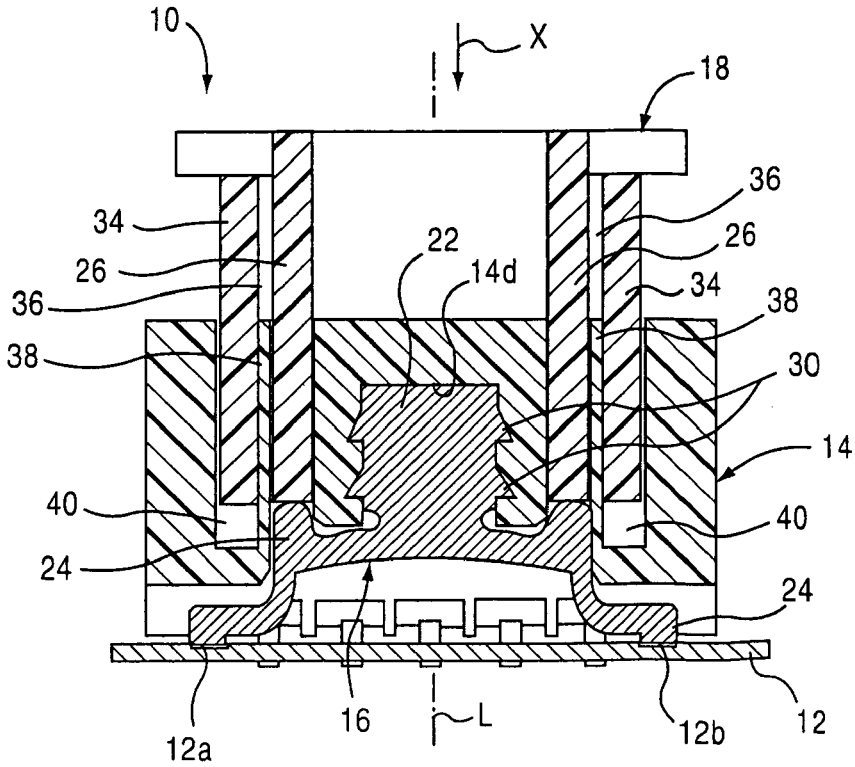
FIG. 6 is a front elevational cross-section view of the connector position assurance apparatus with the header part operably connected to the printed circuit board and the connector part engaged with the header part and contacting an electrically-conductive element in a stressed state.

With reference to FIGS. 4-6, the electrically-conductive element 16 has a main body portion 22 and a pair of electrical contact portions 24 integrally formed with the main body portion 22. However, the electrically-conductive element 16 has at least one electrical contact portion 24 as mentioned below. Further, although not by way of limitation, the pair of electrical contact portions 24 is disposed apart from one another with the main body portion 22 positioned between the pair of electrical contact portions 24. The electrically-conductive element 16 is connected to the header part 14 at the main body portion 22. Each one of the pair of the electrical contact portions 24 is movable between a relaxed state as shown in FIGS. 4 and 5 and a stressed state as shown in FIG. 6. However, each one of the pair of electrical contact portions 24 is resiliently biased to the relaxed state.

Figures 7A, 7B, 7C, 7D:
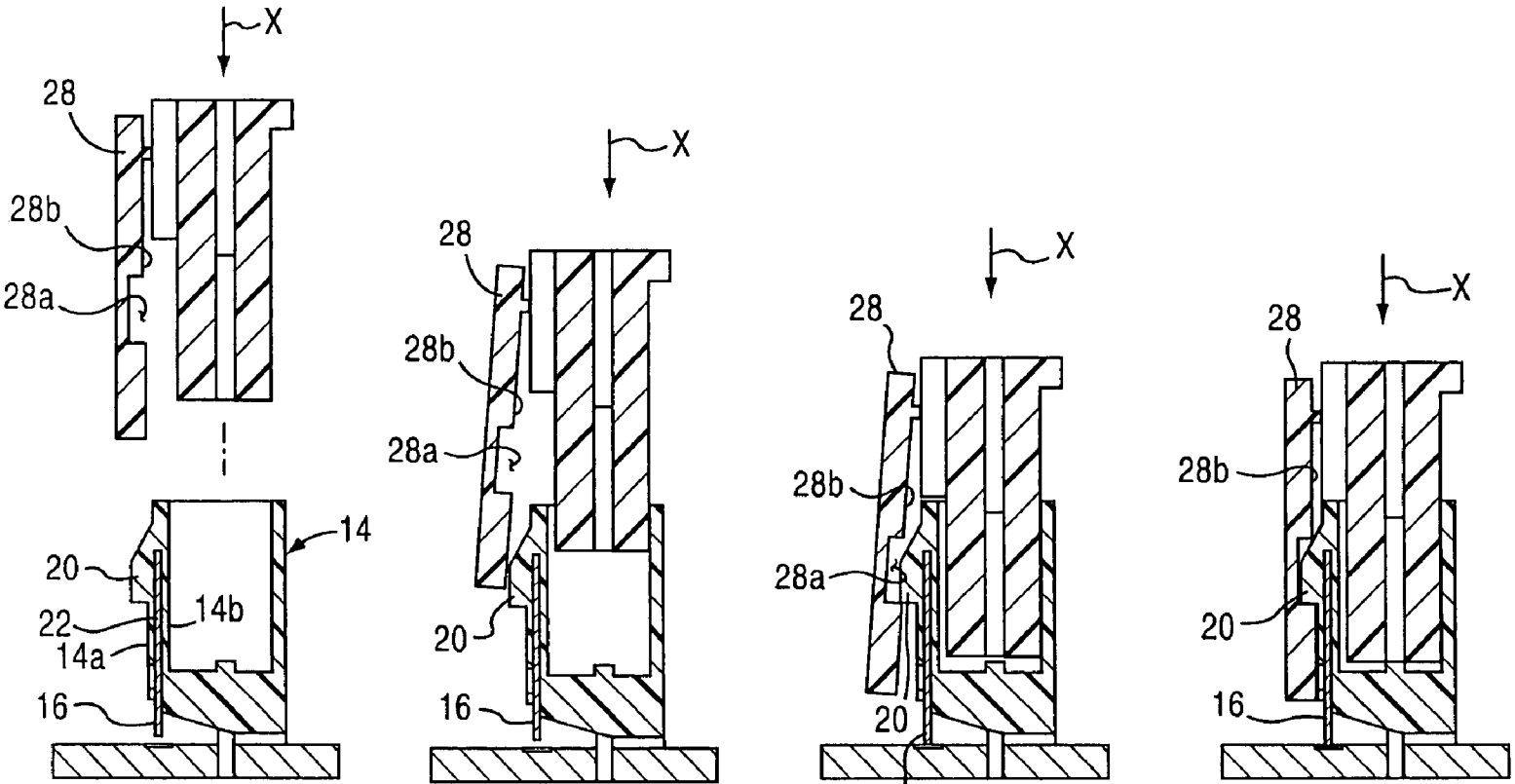
FIGS. 7(*a*) through 7(*d*) is a series of cross-sectional views illustrating a latch member pivotably moving from a relaxed condition to a flexed condition and then back to the relaxed condition again when a catch-receiving chamber formed in the latch member receives a catch projecting from the header part.

In FIGS. 1-3, the connector part 18 having an outer connector part surface 18*a*. In FIGS. 1-6, the connector part 18 is sized and adapted to be slidably received by the interior connector-receiving chamber 14*c* (FIG. 2) of the header part 14. The connector part 18 has a pair of polarity tabs 26 and a latch member 28. However, one of ordinary skill in the art would appreciate that the connector position assurance apparatus 10 of the present invention might include only one polarity tab 26 and thus would have at least one polarity tab 26. As illustrated in FIGS. 1-3 and 7(*a*)-7(*b*), the latch member 28 has a catch-receiving chamber 28*a* formed therein. Also, as best referred to in FIGS. 7(*a*)-7(*d*) the latch member is pivotably movable to and between a relaxed condition as shown in FIGS. 7(*a*) and 7(*d*) and a flexed condition as shown in FIGS. 7(*b*) and 7(*c*). The latch member 28 is resiliently biased to the relaxed condition as shown in FIGS. 7(*a*) and 7(*d*).

As best illustrated in FIGS. 3-6, the connector part 18 is received by the interior connector-receiving chamber 14*c* (see FIG. 2) in a connector receiving direction X, respective ones of the pair of polarity tab 26 contact respective ones of the pair of electrical contact portions 24 (FIGS. 5 and 6) causing each one of the electrical contact portions 24 to move from the relaxed state (for example, in FIG. 5) to the stressed state in FIG. 6 when the respective ones of the pair of electrical contact portions 24 contact the respective ones of the first and second printed circuit board contacts 12*a* and 12*b* (FIG. 6) and the latch member 28 slides onto and over the catch 20 as illustrated in series in FIGS. 7(*a*)-7(*b*) causing the latch member to pivotably move from the relaxed condition in FIG. 7(*a*) to the flexed condition in FIGS. 7(*b*) and 7(*c*) and then back to the relaxed condition in FIG. 7(*d*) again when the catch-receiving chamber 28*a* receives the catch 20. Thus, the connector part 18 and the header part 14 are releasably locked together while the pair of polarity tabs retain the respective ones of the pair of electrical contact portions 24 in the stressed state (FIG. 6) and in electrical contact with the respective ones of the first and second printed circuit board contacts 12*a* and 12*b* resulting in electrical communication between the first and second printed circuit board contacts 12*a* and 12*b* via the electrically-conductive element 16. A skilled artisan would appreciate that the connector receiving direction X parallels a longitudinal direction represented by the longitudinal axis L.

Although not by way of limitation and as illustrated for example purposes only in FIGS. 4-7(*d*), the electrically-conductive element 16 is a flat panel piece fabricated from an electrically-conductive metal material. In FIGS. 4-6, the main body portion 22 of the electrically-conductive element 16 includes barbs 30. The barbs 30 extend laterally from the main body portion 22 generally perpendicularly to the longitudinal direction. Also, in FIGS. 4-6, the header part 14 has a cavity 14d formed thereinto. The cavity 14*d* is sized and adapted to receive the main body portion 22 of the electrically-conductive element 16 in a manner that the barbs 30 penetrate into the header part 14 in order to retain the electrically-conductive element 16 and the header part 14 connected together. In other words, the main body portion 22 of the electrically-conductive element 16 can be considered embedded into the header part 14 and the barbs 30 assist in retaining the embedded main body portion 22 of the electrically-conductive element 16 connected to the header part 14.

Figure 8:
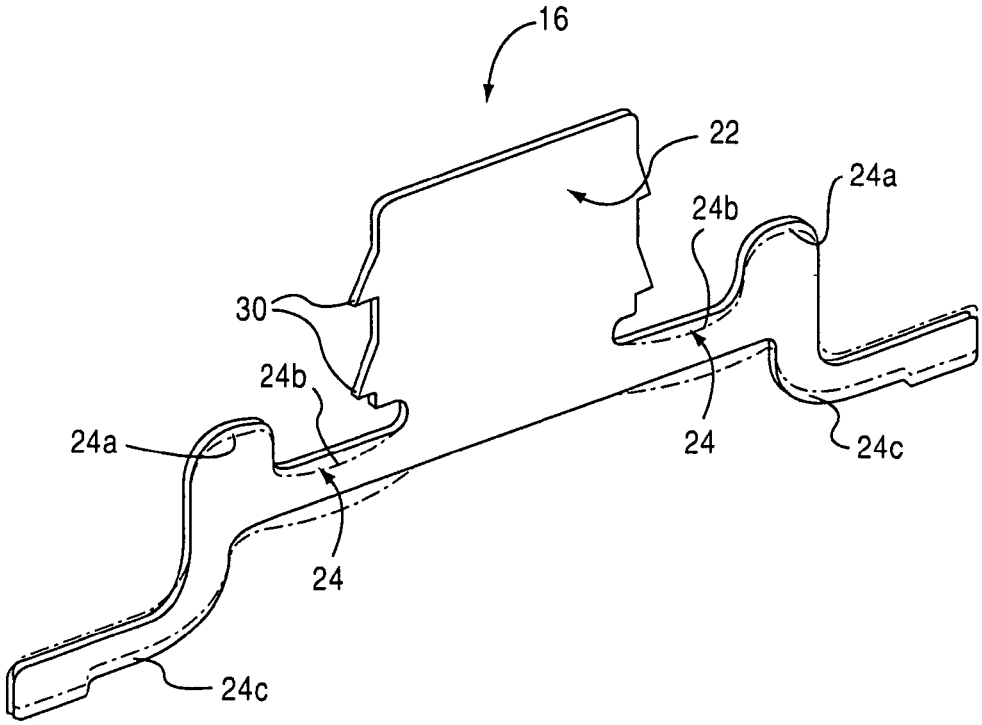
FIG. 8 is an enlarged perspective view of an electrically-conductive element shown in the relaxed state and, phantomly, in the stressed state.

FIG. 8 illustrates an enlarged electrically-conductive element 16 in perspective view. As mentioned above, the electrically-conductive element 16 includes the main body portion 22 and the electrical contact portions 24. Each one of the electrical contact portions 24 includes a shoulder portion 24*a*, a bridge portion 24*b* and a bent-arm portion 24*c*. The shoulder portion 24*a* is integrally connected to and between the bridge portion 24*b* and the bent-arm portion 24*c*. Also, the bridge portion 24*b* integrally connected to the main body portion 22. As shown in the solid lines, the respective ones of the pair of electrical contact portions 24 are in the relaxed state and, as shown in the phantomly drawn lines, the respective ones of the pair of electrical contact portions 24 are in the stressed state. 21. When the electrical contact portions 24 of the electrically-conductive element 16 are in the stressed state, respective ones of the pair of polarity tabs 26 in FIG. 6 push downwardly on the shoulder portion 24*a* causing the bridge portion 24*b* to flex downwardly as shown in FIG. 8 relative to the main body portion 22 toward the printed circuit board (in FIG. 6) and the respective ones of the pair of bent-arm portions 24*c* contact first and second electrical printed circuit board contacts 12*a* and 12*b* of the printed circuit board 12 and flex upwardly relative the printed circuit board 12. Further, as best showing in FIG. 7(*a*), the main body portion 22 of the electrically-conductive element 16 is connected to the header part 14 between the header outer surface 14*a* and the header inner surface 14*b*.

In FIGS. 1 and 2, each one of the pair of the polarity tabs 26 extends in the connector receiving direction X and the header part 14 includes a pair of polarity tab-receiving channels 32 (FIG. 2). Each one of the pair of polarity tab-receiving channels 32 is sized and positioned to slidably receive respective ones of the pair of polarity tabs 26 in a close-fitting relationship. Each one of the pair of polarity tabs 26 and each one of the pair of polarity tab-receiving channels 32 extend parallel to the connector receiving direction X. Also, each one of the pair of polarity tab-receiving channels 32 is in communication with the interior connector-receiving chamber 14*c*. Additionally, the connector part 18 includes a pair of connector rails 34 extending parallel to the pair of polarity tabs 26 and are disposed apart therefrom to form respective ones of header guide rail-receiving channels 36 between respective ones of the polarity tab 26 and connector rail 34 as best shown in FIGS. 1 and 2.

Correspondingly, as best shown in FIG. 2, the header part 14 includes a pair of header guide rails 38 and a pair of connector rail-receiving channels 40. The pair of header guide rails 38 are disposed within the interior connector-receiving chamber 14*c* and extend parallel to the connector receiving direction X. The pair of connector rail-receiving channels are in communication with the interior connector-receiving chamber 14*c*. The pair of header guide rails 38 are disposed between respective ones of the pair of connector rail-receiving channels 40 and the pair of polarity tab-receiving channels 32. Each one of the pair of header guide-rail receiving channels 36 is sized to slidably receive a respective one of the header guide rail 38 in a close-fitting relationship as best shown in FIGS. 5 and 6.

Additionally, as shown in FIGS. 1-3, each polarity tab 26 might include a stop element 42 that projects from the polarity tab 26 perpendicularly to the connector receiving direction. Also, the connector position assurance apparatus includes a fulcrum piece 44, as best shown in FIG. 2, that is connected to and disposed between the outer connector part surface 18*a* of the connector part 18 and the latch member 28. The fulcrum piece 44 is integrally formed with the outer connector part surface 18*a* of the connector part 18 and the latch member 28 as a unitary construction. The fulcrum 44 is operative to enable the latch member 28 to pivotably move to and between the relaxed condition (for example, in FIGS. 7(*a*) and 7(*d*)) and the flexed condition (for example, in FIGS. 7(*b*) and 7(*c*)). Also, as shown in FIGS. 7(*a*)-7(*d*), the latch member 28 has a flat latch member surface 28*b* in which the catch-receiving chamber 28*a* is formed therein. The fulcrum piece 44 is connected to the latch member surface 28*b* adjacent the catch-receiving chamber 28*a* so that the latch member 28 pivotably moves in a see-saw manner as reflected in FIGS. 7(*a*)-7(*d*).

Figure 9:
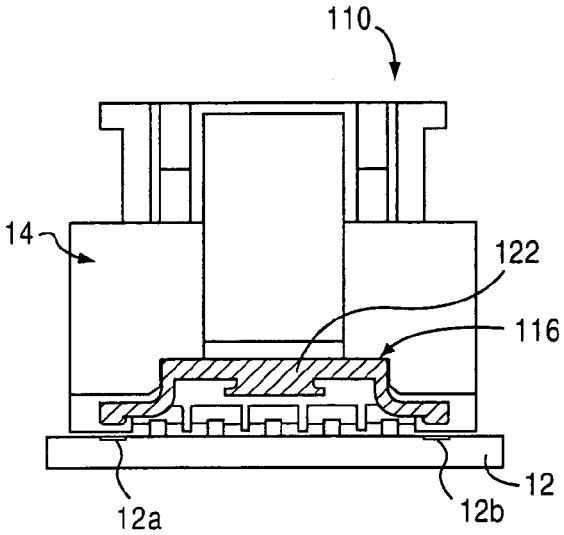
FIG. 9 is a front elevational view of another exemplary embodiment of the connector position assurance apparatus of the present invention.
Figure 10:
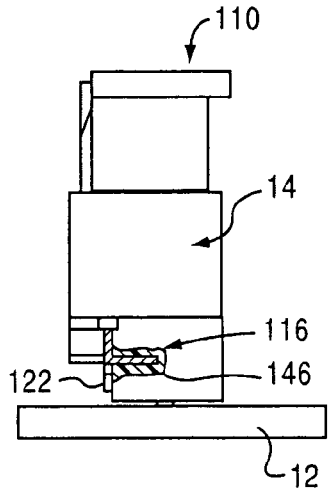
FIG. 10 is a side elevational view partially in cross-section of the connector position assurance apparatus shown in FIG. 9.

Another exemplary embodiment of the connector position assurance apparatus 110 of the present invention is illustrated in FIGS. 9 and 10. The connector position assurance apparatus 110 is similar to the connector position assurance apparatus 10 described above except for an electrically-conductive element 116. A main body portion 122 is smaller in cross-sectional area relative to the main body portion 22 discussed above and includes an anchor projection 146 that is embedded in the header part 14.

Figure 11:
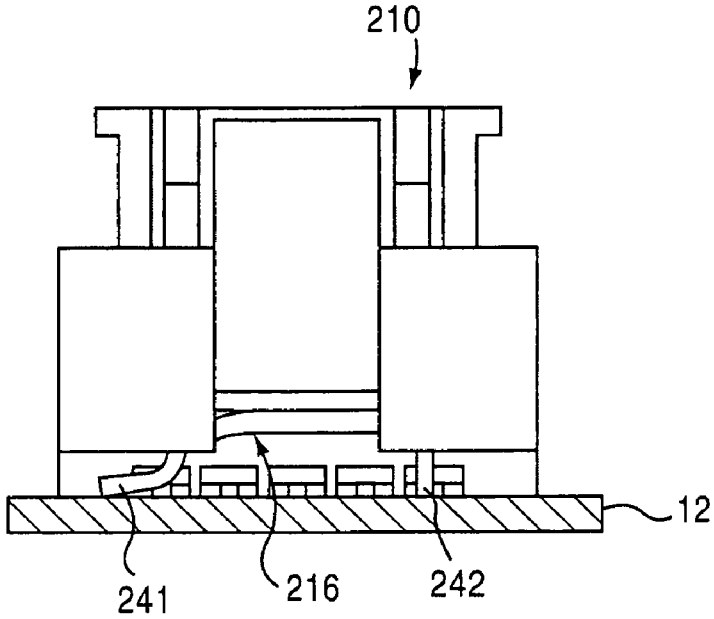
FIG. 11 is a front elevational view of yet another exemplary embodiment of the connector position assurance apparatus of the present invention.
Figure 12:
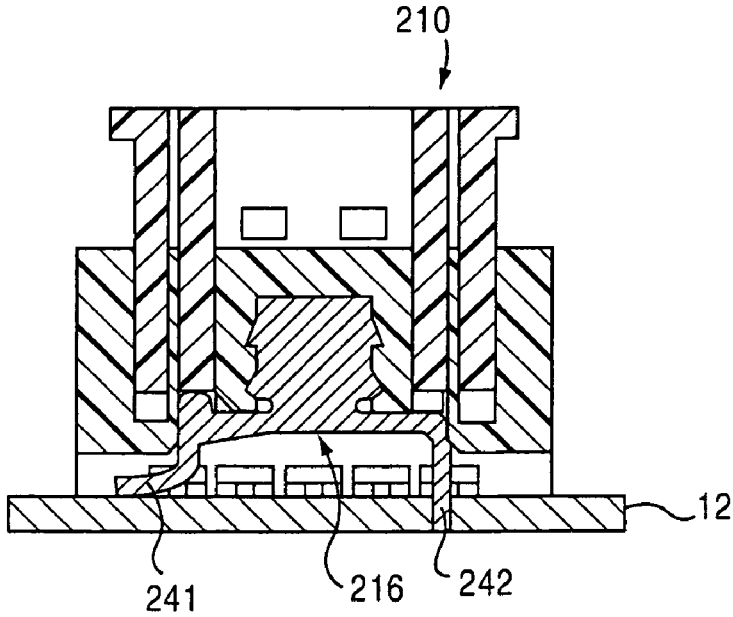
FIG. 12 is a side elevational view in cross-section of the connector position assurance apparatus shown in FIG. 11.

Yet another exemplary embodiment of the connector position assurance apparatus 210 of the present invention is illustrated in FIGS. 11 and 12. The connector position assurance apparatus 210 is similar to the connector position assurance apparatus 10 described above except for an electrically-conductive element 216. Note that the electrically-conductive element 216 includes two different configurations of electrical contact portions 241 and 242. The electrical contact portion 241 is similar to the ones described above regarding the connector position assurance apparatus 10. However, the electrical contact portion 242 is configured as a straight lance terminal that penetrates into the printed circuit board 12.

A skilled artisan would appreciate that the connector position assurance apparatus 10 might have at least one polarity tab 26 instead of the pair of polarity tabs 26 discussed above; the connector position assurance apparatus 10 might have at least one polarity tab-receiving channel 32 instead of the pair of polarity tab-receiving channels 32 discussed above; the connector position assurance apparatus 10 might have at least one connector rail 34 instead of the pair of connector rails discussed above; the connector position assurance apparatus 10 might have at least one header guide rail 38 instead of the pair of header guide rails 38 discussed above; and, the connector position assurance apparatus 10 might have at least one connector rail-receiving channel 40 instead of the pair of connector rail-receiving channels 40 discussed above.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A connector position assurance apparatus, comprising:

a header part having a header outer surface and a header inner surface, the header inner surface defining an interior connector-receiving chamber, the header part having a catch connected to and projecting from the header outer surface;

an electrically-conductive element having a main body portion and at least one electrical contact portion integrally formed with the main body portion, the electrically-conductive element being connected to the header part at the main body portion, the at least one electrical contact portion movable between a relaxed state and a stressed state and resiliently biased to the relaxed state;

a connector part having an outer connector part surface and sized and adapted to be slidably received by the interior connector-receiving chamber of the header part and having at least one polarity tab and a latch member connected to the outer connector part surface, the latch member having a catch-receiving chamber formed therein and pivotably movable to and between a relaxed condition and a flexed condition, the latch member resiliently biased to the relaxed condition, wherein, as the connector part is received by the interior connector-receiving chamber in a connector receiving direction, the at least one polarity tab contacts the at least one electrical contact portion causing the at least one electrical contact portion to move from the relaxed state to the stressed state while the latch member slides onto and over the catch causing the latch member to pivotably move from the relaxed condition to the flexed condition and then back to the relaxed condition again when the catch-receiving chamber receives the catch thereby releasably locking the connector part and the header part together while the at least one polarity tab retains the at least one electrical contact portion in the stressed state.

2. A connector position assurance apparatus according to claim 1, wherein the electrically-conductive element is a flat panel piece fabricated from a metal material.

3. A connector position assurance apparatus according to claim 2, wherein the main body portion of the electrically-conductive element includes barbs extending laterally from the main body portion.

4. A connector position assurance apparatus according to claim 3, wherein the header part has a cavity formed thereinto sized and adapted to receive the main body portion of the electrically-conductive element in a manner that the barbs penetrate into the header part to retain the electrically-conductive element and the header part connected together.

5. A connector position assurance apparatus according to claim 1, wherein the at least one electrical contact portion includes a shoulder portion, a bridge portion and a bent-arm portion, the shoulder portion being integrally connected to and between the bridge portion and the bent-arm portion, the bridge portion integrally connected to the main body portion.

6. A connector position assurance apparatus according to claim 1, wherein the main body portion of the electrically-conductive element is connected to the header part between the header outer surface and the header inner surface.

7. A connector position assurance apparatus according to claim 6, wherein the main body portion of the electrically-conductive element is embedded into the header part.

8. A connector position assurance apparatus according to claim 1, wherein the main body portion includes an anchor projection connected to and embedded in the header part.

9. A connector position assurance apparatus according to claim 1, wherein the at least one electrical contact portion of the electrically-conductive element includes a pair of electrical contact portions disposed apart from one another with the main body portion positioned therebetween.

10. A connector position assurance apparatus according to claim 1, wherein the at least one polarity tab extends in the connector receiving direction and the header part includes at least one polarity tab-receiving channel sized and positioned to slidably receive the at least one polarity tab in a close-fitting relationship, the at least one polarity tab and the at least one polarity tab-receiving channel extending parallel to the connector receiving direction, the at least one polarity tab-receiving channel being in communication with the interior connector-receiving chamber.

11. A connector position assurance apparatus according to claim 10, wherein the connector part includes at least one connector rail extending parallel to the at least one polarity tab and disposed apart therefrom to form at least one header guide rail-receiving channel therebetween.

12. A connector position assurance apparatus according to claim 11, wherein the header part includes at least one header guide rail disposed within the interior connector-receiving chamber and extending parallel to the connector receiving direction and at least one connector rail-receiving channel in communication with the interior connector-receiving chamber, the at least one header guide rail disposed between the at least one connector rail-receiving channel and the at least one polarity tab-receiving channel, the at least one header guide-rail receiving channel sized to slidably receive the at least one header guide rail in a close-fitting relationship.

13. A connector position assurance apparatus according to claim 10, wherein the at least one polarity tab includes a stop element projecting perpendicularly to the connector receiving direction.

14. A connector position assurance apparatus according to claim 1, wherein the at least one polarity tab includes a pair of polarity tabs disposed apart from one another and extending in the connector receiving direction, the header part includes a pair of polarity tab-receiving channels disposed apart from one another and extending parallel to each other in the connector receiving direction, respective ones of the pair of polarity tab-receiving channels sized and positioned to slidably receive respective ones of the pair of polarity tabs in a close-fitting relationship, the respective one of the pair of polarity tab-receiving channels being in communication with the interior connector-receiving chamber.

15. A connector position assurance apparatus according to claim 14, wherein the connector part includes a pair of connector rails extending parallel to the pair of polarity tabs, respective ones of the pair of connector rails being disposed apart from respective ones of the pair of polarity tabs to form respective ones of a pair of header guide rail-receiving channels therebetween.

16. A connector position assurance apparatus according to claim 15, wherein the header part includes a pair of header guide rails disposed apart from one another within the interior connector-receiving chamber and extending parallel to the connector receiving direction and a pair of connector rail-receiving channels in communication with the interior connector-receiving chamber and extending parallel to one another in the connector receiving direction, respective ones of the pair of header guide rails being disposed between respective ones of the connector rail-receiving channels and respective ones of the pair of polarity tab-receiving channels, each one of the pair of header guide-rail receiving channels sized to slidably receive a respective one of the header guide rails in a close-fitting relationship.

17. A connector position assurance apparatus according to claim 1, wherein the connector part has an outer connector part surface and a fulcrum piece connected to and disposed between the outer connector part surface of the connector part and the latch member, the fulcrum piece being integrally formed with the outer connector part surface of the connector part and the latch member as a unitary construction and operative to enable the latch member to pivotably move to and between the relaxed condition and the flexed condition.

18. A connector position assurance apparatus according to claim 17, wherein the latch member has a flat latch member surface in which the catch-receiving chamber is formed therein and the fulcrum piece is connected to the latch member surface adjacent the catch-receiving chamber so that the latch member pivotably moves in a see-saw manner.

19. A connector position assurance apparatus adapted for use with a printed circuit board having a first electrical printed circuit board contact and a second printed circuit board electrical contact electrically isolated from the first electrical printed circuit board contact, the connector position assurance apparatus comprising:

a header part operably connected to the printed circuit board and having a header outer surface and a header inner surface, the header inner surface defining an interior connector-receiving chamber, the header part having a catch connected to and projecting from the header outer surface;

an electrically-conductive element having a main body portion and at least one electrical contact portion integrally formed with the main body portion, the electrically-conductive element being connected to the header part at the main body portion, the at least one electrical contact portion movable between a relaxed state and a stressed state and resiliently biased to the relaxed state;

a connector part having an outer connector part surface and sized and adapted to be slidably received by the interior connector-receiving chamber of the header part and having at least one polarity tab and a latch member, the latch member having a catch-receiving chamber formed therein and pivotably movable to and between a relaxed condition and a flexed condition, the latch member resiliently biased to the relaxed condition, wherein, as the connector part is received by the interior connector-receiving chamber in a connector receiving direction, the at least one polarity tab contacts the at least one electrical contact portion causing the at least one electrical contact portion to move from the relaxed state to the stressed state when the at least one electrical contact portion contacts one of the first and second printed circuit board contacts while the latch member slides onto and over the catch causing the latch member to pivotably move from the relaxed condition to the flexed condition and then back to the relaxed condition again when the catch-receiving chamber receives the catch thereby releasably locking the connector part and the header part together while the at least one polarity tab retains the at least one electrical contact portion in the stressed state and in electrical contact with the one of the first and second printed circuit board contacts resulting in electrical communication between the first and second printed circuit board contacts.

20. A connector position assurance apparatus according to claim 19, wherein the at least one electrical contact portion includes a shoulder portion, a bridge portion and a bent-arm portion, the shoulder portion being integrally connected to and between the bridge portion and the bent-arm portion, the bridge portion integrally connected to the main body portion.

21. A connector position assurance apparatus according to claim 20, wherein, when the electrically-conductive element is in the stressed state, the at least one polarity tab pushes downwardly on the shoulder portion causing the bridge portion to flex downwardly relative to the main body portion toward the printed circuit board and the bent-arm portion contacts the printed circuit board and flexes upwardly relative the printed circuit board.

22. A header part, comprising:

a header body having a header outer surface and a header inner surface, the header inner surface defining an interior connector-receiving chamber extending along a longitudinal direction, the header part having a catch connected to and projecting from the header outer surface and having a cavity formed between the header outer surface and the header inner surface, the header part including at least one polarity tab-receiving channel extending in the longitudinal direction and in communication with the interior connector-receiving chamber, the header part including at least one header guide rail disposed within the interior connector-receiving chamber and extending parallel to the longitudinal direction and at least one connector rail-receiving channel in communication with the interior connector-receiving chamber, the at least one header guide rail disposed between the at least one connector rail-receiving channel and the at least one polarity tab-receiving channel.

23. A header part according to claim 22, wherein the at least one polarity tab-receiving channel includes a pair of polarity tab-receiving channels disposed apart from one another and extending parallel to each other in the connector receiving direction, the at least one header guide rail includes a pair of header guide rails disposed apart from one another within the interior connector-receiving chamber and extending parallel to each other in the longitudinal and the at least one connector rail-receiving channels includes a pair of connector rail-receiving channels in communication with the interior connector-receiving chamber and extending parallel to one another in the longitudinal direction, respective ones of the pair of header guide rails being disposed between respective ones of the connector rail-receiving channels and respective ones of the pair of polarity tab-receiving channels.

24. An electrically-conductive element, comprising:

an electrically-conductive element body having a main body portion and at least one electrical contact portion integrally formed with and extending laterally from the main body portion, the at least one electrical contact portion movable between a relaxed state and a stressed state and resiliently biased to the relaxed state, the at least one electrical contact portion including a shoulder portion, a bridge portion and a bent-arm portion, the shoulder portion being integrally connected to and between the bridge portion and the bent-arm portion, the bridge portion integrally connected to the main body portion, wherein the main body portion, the shoulder portion, the bridge portion and the bent-arm portion are flat and are disposed in a common x-y plane and wherein, when the at least one electrical contact portion moves from the relaxed state to the stressed state, the bridge portion moves downwardly relative to the main body portion while simultaneously the bent-arm portion moves upwardly relative to the main body portion.

25. An electrically-conductive element according to claim 24, wherein the main body portion includes a plate piece extending generally in the x-y plane and an anchor projection connected to the plate piece and extending perpendicularly from the x-y plane.

26. An electrically-conductive element according to claim 24, wherein the at least one electrical contact portion of the electrically-conductive element includes two electrical contact portions disposed apart from one another with the main body portion positioned therebetween.

27. An electrically-conductive element according to claim 24, wherein the electrically-conductive element is a flat panel piece fabricated from a metal material.

28. An electrically-conductive element according to claim 24, wherein the main body portion of the electrically-conductive element includes barbs extending laterally from the main body portion.

29. A connector part, comprising:

a connector part body having an outer connector part surface and extending in a longitudinal direction, the connector part body having at least one polarity tab and a latch member connected to the outer connector part surface, the latch member having a catch-receiving chamber formed therein and pivotably movable to and between a relaxed condition and a flexed condition, the latch member resiliently biased to the relaxed condition, the connector part includes at least one connector rail extending parallel to the at least one polarity tab and disposed apart therefrom to form at least one header guide rail-receiving channel therebetween.

30. A connector part according to claim 29, wherein the at least one polarity tab includes a stop element projecting perpendicularly to the connector receiving direction.

31. A connector part according to claim 29, wherein the at least one polarity tab includes a pair of polarity tabs disposed apart from one another and extending in the longitudinal direction and the at least one connector rail includes a pair of connector rails extending parallel to the pair of polarity tabs, respective ones of the pair of connector rails being disposed apart from respective ones of the pair of polarity tabs to form respective ones of a pair of header guide rail-receiving channels therebetween.

32. A connector part according to claim 29, wherein the connector part has an outer connector part surface and a fulcrum piece connected to and disposed between the outer connector part surface of the connector part and the latch member, the fulcrum piece being integrally formed with the outer connector part surface of the connector part and the latch member as a unitary construction and operative to enable the latch member to pivotably move to and between the relaxed condition and the flexed condition.

33. A connector part according to claim 29, wherein the latch member has a flat latch member surface in which the catch-receiving chamber is formed therein and the fulcrum piece is connected to the latch member surface adjacent the catch-receiving chamber so that the latch member pivotably moves in a see-saw manner.

* * * * *